US009434501B2

(12) United States Patent
Little

(10) Patent No.: US 9,434,501 B2
(45) **Date of Patent: *Sep. 6, 2016**

(54) MATERIALS AND METHOD FOR MAKING A CONTAINER WITH A LOCKING CLOSURE

(71) Applicant: YORK CONTAINER COMPANY, York, PA (US)

(72) Inventor: Troy Little, Thomasville, PA (US)

(73) Assignee: YORK CONTAINER COMPANY, York, PA (US)

( * ) Notice: Subject to any disclaimer, the term of this patent is extended or adjusted under 35 U.S.C. 154(b) by 440 days.

This patent is subject to a terminal disclaimer.

(21) Appl. No.: 14/038,188

(22) Filed: Sep. 26, 2013

(65) Prior Publication Data

US 2014/0024510 A1 Jan. 23, 2014

Related U.S. Application Data

(62) Division of application No. 13/090,644, filed on Apr. 20, 2011, now Pat. No. 8,925,795.

(60) Provisional application No. 61/326,781, filed on Apr. 22, 2010.

(51) Int. Cl.

| | |
|---|---|
| ***B65D 5/30*** | (2006.01) |
| ***B31B 5/00*** | (2006.01) |
| ***B31B 1/60*** | (2006.01) |
| ***B65D 5/10*** | (2006.01) |
| ***B65D 5/02*** | (2006.01) |
| ***B65D 5/36*** | (2006.01) |

(52) U.S. Cl.

CPC ..... *B65D 5/103* (2013.01); *B65D 5/0227* (2013.01); *B65D 5/0254* (2013.01); *B65D 5/10* (2013.01); *B65D 5/3621* (2013.01)

(58) Field of Classification Search

CPC ..... B65D 5/10; B65D 5/0254; B65D 5/103; Y10S 206/815

USPC ..... 229/159, 150, 117, 156, 155, 126, 185; 493/137, 122, 183

See application file for complete search history.

(56) References Cited

U.S. PATENT DOCUMENTS

| | | | |
|---|---|---|---|
| 1,808,772 | A | 6/1926 | Ethridge |
| 2,337,039 | A | 5/1941 | Gardner, Jr. |
| 2,713,965 | A | 5/1953 | Acker |
| 3,081,017 | A | 3/1963 | Gerbino |
| 3,229,891 | A | 1/1966 | Edelman |
| 3,258,192 | A | 6/1966 | Kelty |
| 3,319,869 | A | 5/1967 | Ostwald |
| 3,337,115 | A | 8/1967 | Jones |
| 3,580,482 | A | 5/1971 | Witte |
| 3,770,187 | A | 11/1973 | Faires et al. |
| 4,017,018 | A | 4/1977 | Pellation |
| 4,027,818 | A | 6/1977 | Stoll |
| 4,236,662 | A | 12/1980 | Roccaforte |
| 4,238,068 | A | 12/1980 | Ellerbe et al. |
| 4,279,378 | A | 7/1981 | Jenkins |
| 4,572,425 | A | 2/1986 | Russell |
| 4,905,835 | A | 3/1990 | Pivert et al. |
| 5,570,780 | A | 11/1996 | Miller |
| 5,873,516 | A | 2/1999 | Boggs |
| 5,924,625 | A | 7/1999 | Klein et al. |
| 6,640,971 | B2 | 11/2003 | Acevedo |
| 6,688,514 | B2 | 2/2004 | Evans et al. |
| 7,159,761 | B2 | 1/2007 | Abshire et al. |
| 7,278,565 | B2 | 10/2007 | West |
| 7,669,753 | B2 | 3/2010 | West |
| 2005/0011938 | A1 | 1/2005 | West |
| 2008/0116249 | A1 | 5/2008 | West |

*Primary Examiner* — Christopher Demeree

(74) *Attorney, Agent, or Firm* — Barnes & Thornburg LLP

(57) ABSTRACT

A container and a method of forming a container having a locking closure and a method of forming the locking closure. The container includes bottom, side and top walls and at least one of the walls being an opening wall formed of panels which provide an opening to an interior of the container and which overlap to provide the locking a closure of the opening wall. In a closed condition of the container, a bottommost panel of the opening wall is partially overlapped by adjacent panels of the opening wall and a topmost panel of the opening wall located opposite the bottommost panel partially overlaps the adjacent panels and the bottommost panel. A tab of the bottommost panel is lifted upwardly to partially overlap the topmost panel to form the locking closure.

3 Claims, 12 Drawing Sheets

MATERIALS AND METHOD FOR MAKING A CONTAINER WITH A LOCKING CLOSURE

This is a Divisional Application of U.S. Non-Provisional Ser. No. 13/090,644 filed on Apr. 20, 2011 which U.S. Utility Application claims the benefit of and priority to U.S. Provisional Patent Application No. 61/326,781 filed Apr. 22, 2010, the disclosures of which Provisional and Non-Provisional Applications are incorporated herein by reference in their entirety.

BACKGROUND AND SUMMARY

The present disclosure relates in general to the manufacture of containers used to transport product and/or display the product contents of the containers.

Various packages and containers are conventionally provided for transporting product to and storing product in a retail environment, and for display of the product to prospective customers. Such containers, made of a single or of multiple blanks, may be shipped in a knock-down state, for example, flattened but glued, stapled or otherwise affixed or joined together, such that the container is already essentially pre-assembled but not yet erected so as to be in condition to receive and/or store product. From such a knock-down state, known as a preassembly, personnel erecting the container need only open the flattened container by erecting the sides and/or ends of the container and then closing the container bottom and top walls to form the container into its erected condition. Such final assembly is usually performed by the product manufacturer/wholesaler/retailer prior to loading any product into the container.

Conventionally, the top of a container is generally made up of at least two panels but may include four or more panels creating, for example, a quadra-lateral, hexagonal, or octagonal container. The top may then be closed by moving and overlapping the top panels in a sequence to cover the interior of the container. The container may then be locked, for example, by pulling upwardly on an overlapped edge of one of the bottommost of the top panels and pushing downwardly and inwardly on an overlapping edge of one of the topmost of the top panels. This usually requires two hands, with one hand doing the pushing downwardly or inwardly toward the contents of the container on a portion of one of the top panels and the other hand pulling upwardly or outwardly away from the contents of the container.

The downwardly or inwardly motion that would be part of the closing and locking of the top may bruise or damage the contents of the container, such as perishables or other delicate contents.

Depending on the thickness of the panels and the geometry, the manipulated top panels may be themselves damaged.

Such containers, as described above, may include a slit in, for example, the topmost panel to have access to the bottommost panel. Thus, the top may not be completely covered.

A container usually includes at least two panels that form a top of the container. A container, according to the present disclosure, includes a top that includes four top panels and a locking tab on one of the top panels. The locking tab is located on a bottommost panel of the top panels when the four panels have been manipulated to close and cover the exterior of the container. The locking tab is pulled up to and over a topmost panel of the top panels to close and lock the top. Thus, when locking the top, there is no downward motion of any of the top panels and thus there is no contact with the contents of the container. Such a locking tab is configured to easily be unlocked and locked multiple times without damage to the locking tab or to any of the top panels.

The locked top is secure and is configured to resist opening during transit of the container when the container is erected, filled with product and locked.

An embodiment of a container, according to the present disclosure, includes one or more blanks having bottom, side and top walls. The term side walls is used to denote the four sides of a container as opposed to the top and bottom walls of the container. The side walls may be end walls. Each wall may have one or more panels. At least one of the walls is configured to be an opening wall to provide access to the erected and closed container. The opening wall is formed of panels which overlap to provide both the opening to an interior of the container and also to provide a locking closure. In a closed condition, a bottommost panel of the opening wall is partially overlapped by two panels that are each adjacent to the bottommost panel and by a topmost panel located opposite to the bottommost panel and which topmost panel partially overlaps the two adjacent panels. A locking tab of the bottommost panel is configured to be lifted upward and to partially overlap the topmost panel to form the locking closure. During a locking of the container, an extension portion of the locking tab on the bottommost panel is initially located below the topmost panel and is moved upward or outwardly to be above the topmost panel to form the lock and complete the closure.

The present disclosure relates to various embodiments of blanks forming containers and embodiments including various configurations of locking tabs.

Other aspects of the present disclosure will become apparent from the following descriptions when considered in conjunction with the accompanying drawings.

BRIEF DESCRIPTION OF THE DRAWINGS

FIG. 6 illustrates a perspective view of a third step of closing the top and locking the top of the erected container with the locking tab of the blank of FIG. 1.

DETAILED DESCRIPTION

Figure 1:
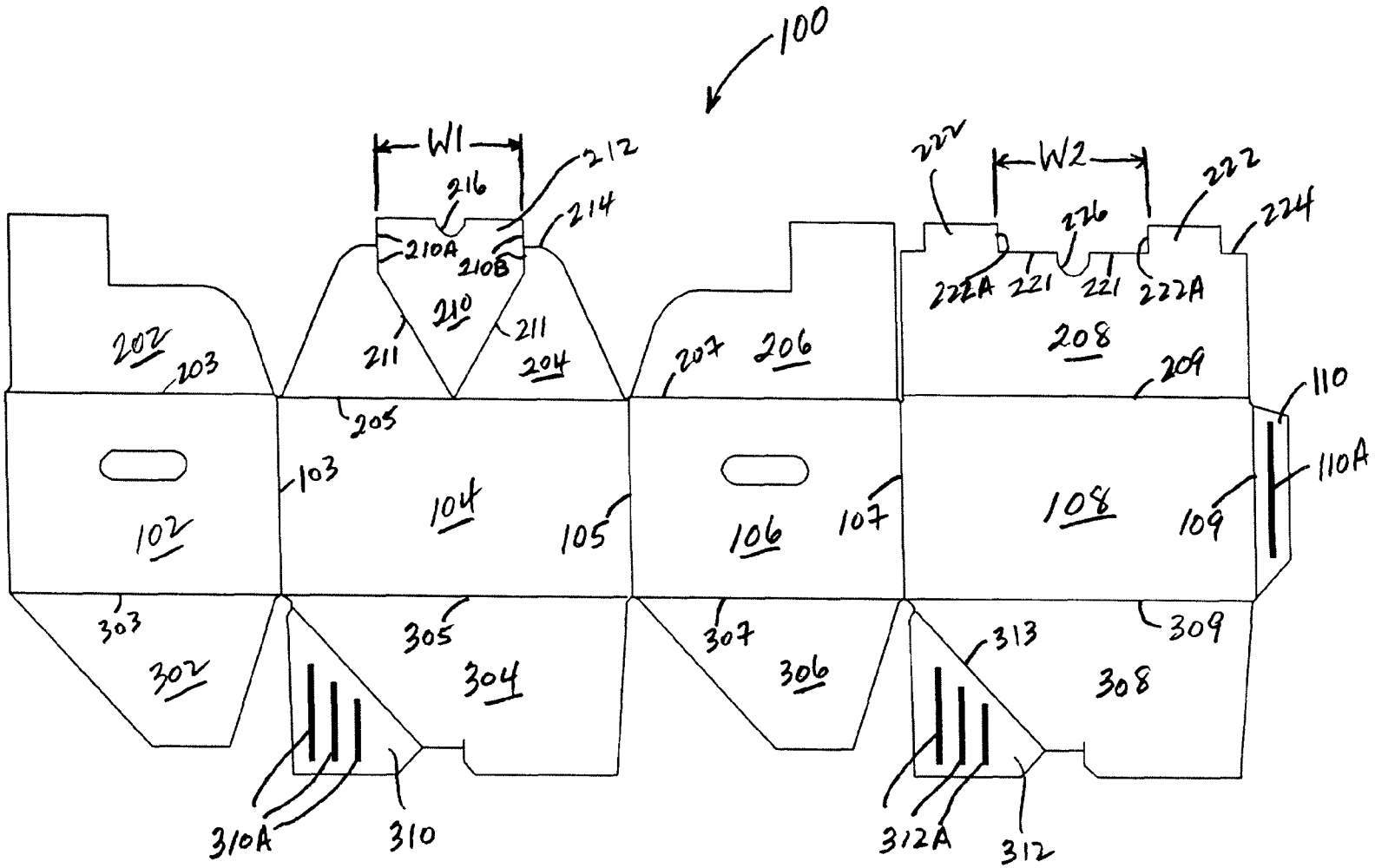
FIG. 1 illustrates a plan view of a first embodiment of a blank used to manufacture a preassembly and a container, the blank including a locking tab, in accordance with the present disclosure.

Herein, the notations of top, bottom and side panels are for relative identification and are not limiting as to orientation. Although a closure or locking closure discussed herein is shown to include or to be a combination of the top panels, the closure may include any panel combination forming interlocking panels. The assembled and erected container is configured to rest or be placed on a side, top, or bottom of the container, such as on one of the side panels 102, 104, 106 and 108 or when top panels 202, 204, 206, 208 or bottom panels 302, 304, 306, 308 are in an erected and closed condition.

In the drawings, solid lines are designated herein as either cut lines or fold lines. If a line is designated as a fold line, then connected elements such as panels or panel portions or panel extensions that are connected by such fold lines enable the connected elements to move relative to each other. The fold lines themselves may have creases or indentations or perforations to assist in such movement. The lines designated as cut lines represent a through-cut separating the adjacent elements, such as panels, extensions or portions.

A blank 100 of a first embodiment, according to the present disclosure, is shown in FIG. 1. Lateral or side panels 102, 104, 106, 108 and attachment panel 110 are joined at fold lines 103, 105, 107 and 109, respectively. Top panels 202, 204, 206, 208 are joined at fold lines 203, 205, 207 and 209 to side panels 102, 104, 106, 108, respectively. Bottom panels 302, 304, 306, 308 are joined at fold lines 303, 305, 307 and 309 to side panels 102, 104, 106, 108, respectively.

Top panel 204 includes a locking tab 210 formed from a portion of top panel 204 and connected to top panel 204 by fold lines 211. The locking tab 210 includes an extension portion 212 which extends past an outer edge 214 of top panel 204. Extension portion 212 is configured to be movable because of cut lines 210A and 210B that separate extension portions 212 from top panel 204. Extension portion 212 is configured to interact with top panel 208 to form a locking closure of the top of a container formed from blank 100. Extension portion 212 has width of W1 at its outer extremity, as shown in FIG. 1. As noted above, extension portion 212 includes cut lines 210A, 210B and also includes a partial cutout or opening 216 to accommodate a finger of a user when manipulating the locking tab 210 to lock the top of the container in a closed condition and to accommodate the finger of the user to unlock and open the top of the container.

Top panel 208 includes a pair of locking portions 221 and a pair of extensions 222 extending past an outer edge 224 of top panel 208. A space between inside edges 222A of extensions 222 is designated as W2. A cutout or partial opening 226 is located in the top panel 208 between those inside edges 222A and is configured to accommodate the finger of the user when the user is manipulating the locking tab 210 via partial openings 216 and 226 to lock the top of the container in a closed condition, and to accommodate the finger of the user to unlock and open the top of the container. The space or width W2 between extensions 222 is sufficiently greater than the width W1 of the extension portion 212 of locking tab 210 to accommodate the extension portion 212.

Complementary side panels 102 and 106 are shown to be approximately square and complementary side panels 104 and 108 as approximately rectangular. However, it is within the scope of the present disclosure that each pair of side panels may be shaped differently. Any of panels 102, 104, 106, 108, 202, 204, 206, 208, 302, 304, 306, 308 may include openings, such as shown in panels 102 and 106 or openings that span across adjacent panels, all according to the present disclosure.

Top panels 202 and 206 are generally L-shaped but may, according to the present disclosure, include different shapes.

Bottom panels 302 and 306 are generally trapezoidal but may, according to the present disclosure, include different shapes. Bottom panels 304 and 308 include panel extension portions 310 and 312, respectively, formed from and joined to bottom panels 304 and 308 by fold lines 311 and 313, respectively. Extension portions 310 and 312 include glue points 310A and 312A, respectively, as shown in FIG. 1.

Figure 2:
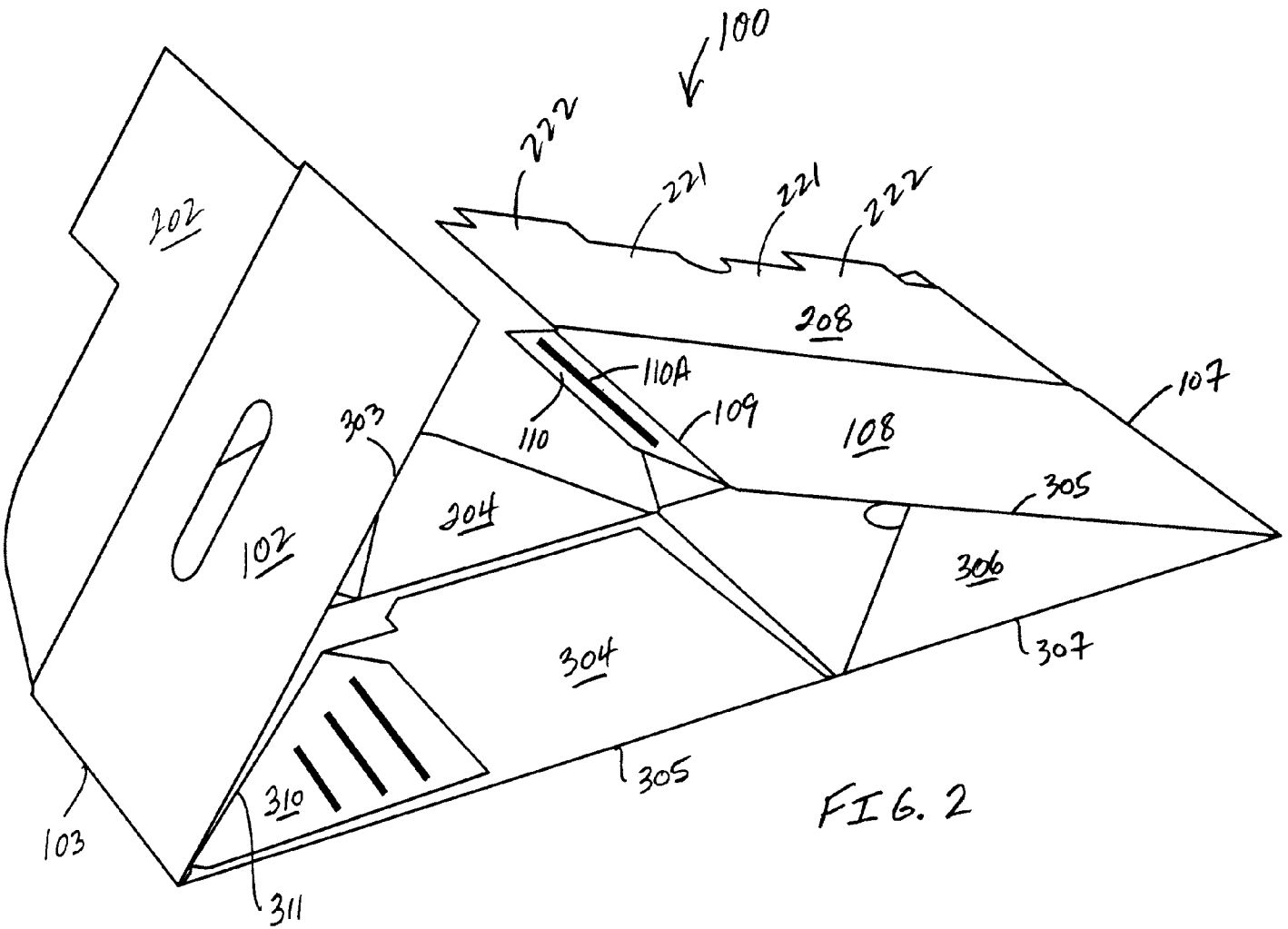
FIG. 2 illustrates a perspective view of a first step of manufacturing the preassembly and container from the blank of FIG. 1.
Figure 3:
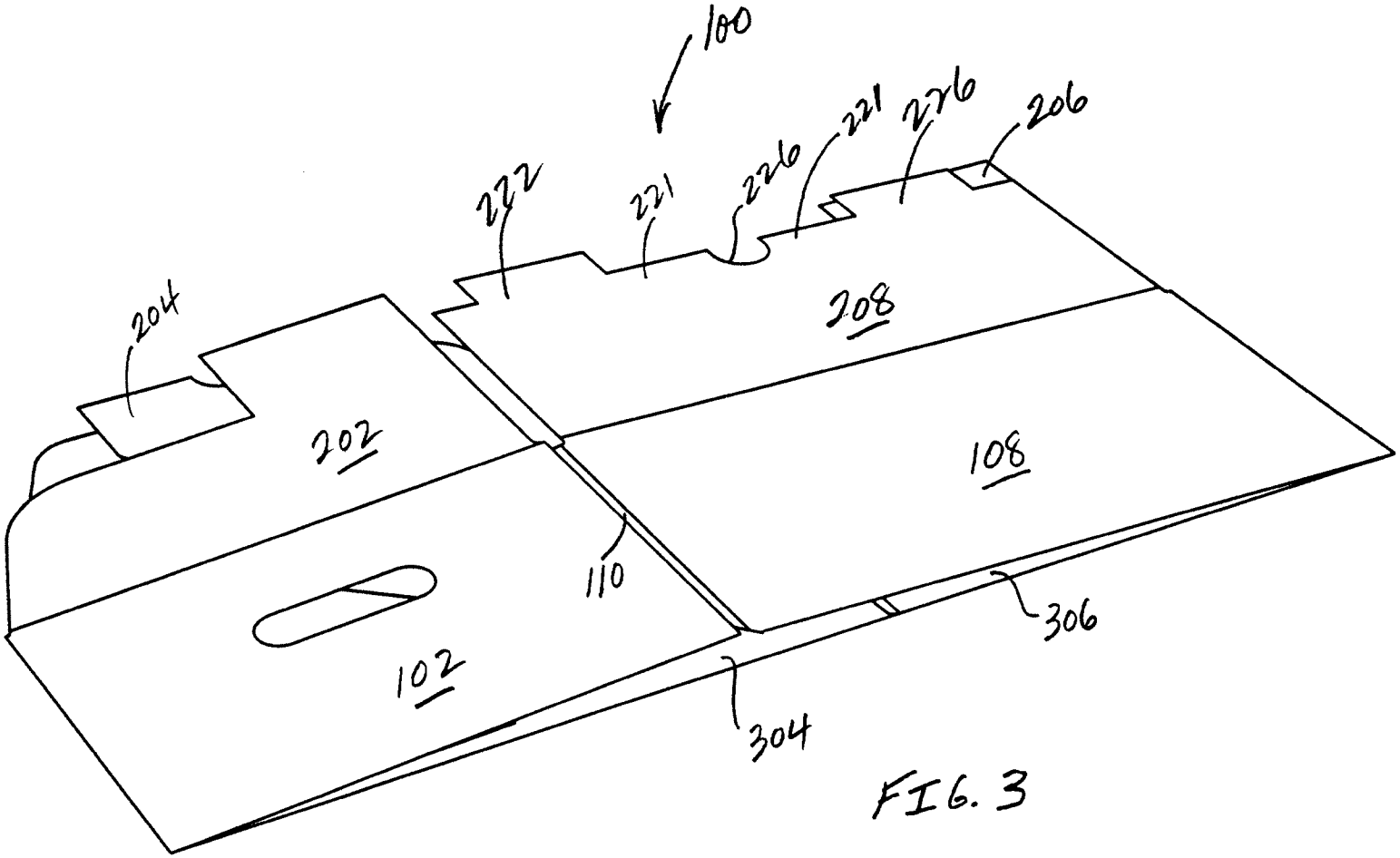
FIG. 3 illustrates a perspective view of a second step of manufacturing the preassembly and container from the blank of FIG. 1, and showing the completed preassembly in a knocked-down, flattened state.

A method of manufacturing a knocked-down or flattened preassembly of the container from the blank 100 includes the following steps: folding panel extension portions 310 and 312 about fold lines 311 and 313, respectively, onto bottom panels 304 and 308, respectively, as shown in FIG. 2; gluing panel extension portions 310 and 312 to portions of bottom panels 302 and 306, respectively, as suggested in FIG. 1 by glue points 310A and 312A on panel extension portions 310 and 312, respectively; folding side panels 102 and 108 about fold lines 103 and 107, respectively; folding a tab extension 110 of side panel 108 along a fold line 109; and, gluing tab extension 110 to side panel 102 via glue paint 110A, as suggested in FIG. 2 and shown in FIG. 3. This completes forming the preassembly from blank 100 of FIG. 1.

Figure 4A:
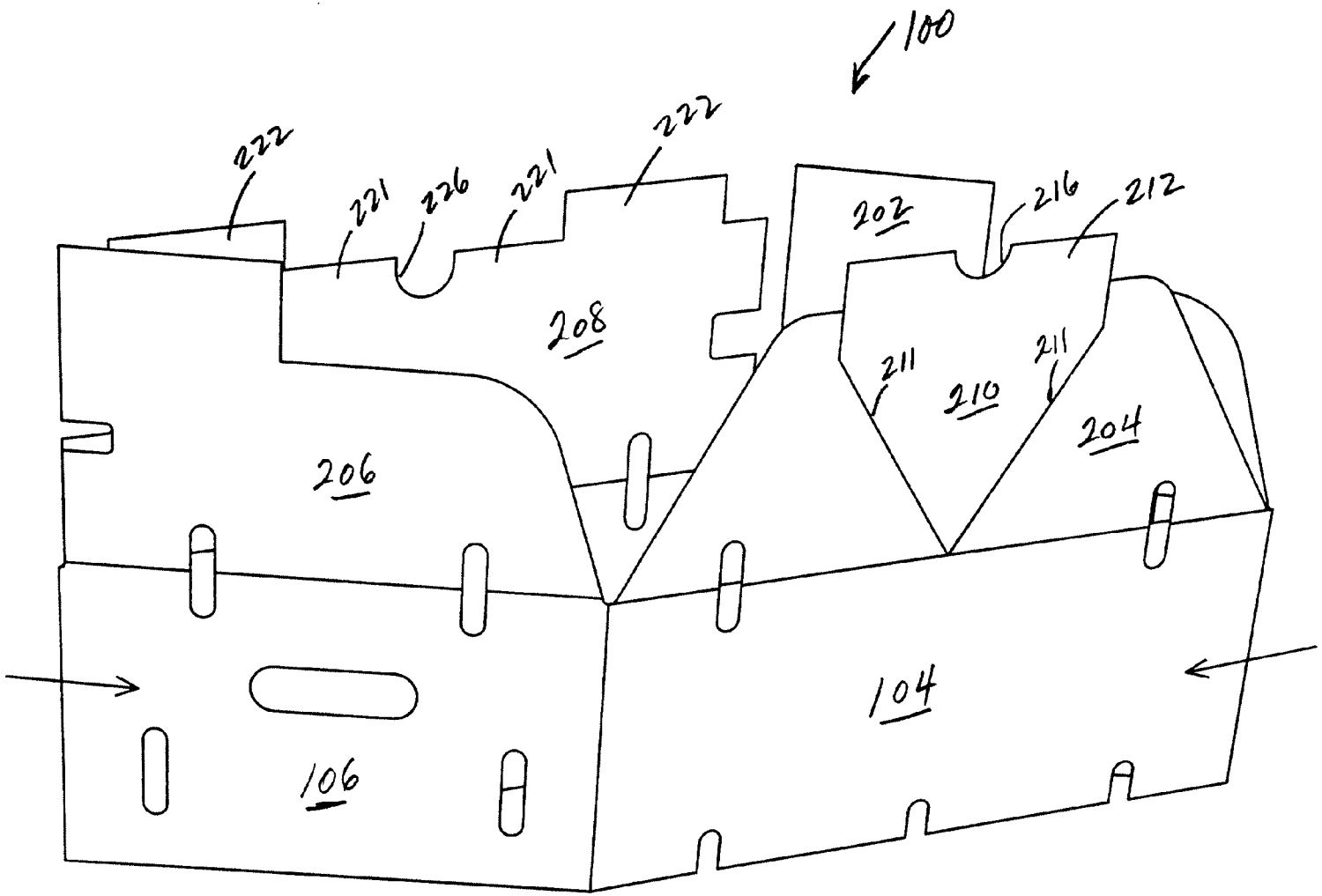
FIG. 4A illustrates a perspective view of a first step in erecting the container from the completed preassembly of FIG. 3, the container have been rotated approximately 180°.
Figure 4B:
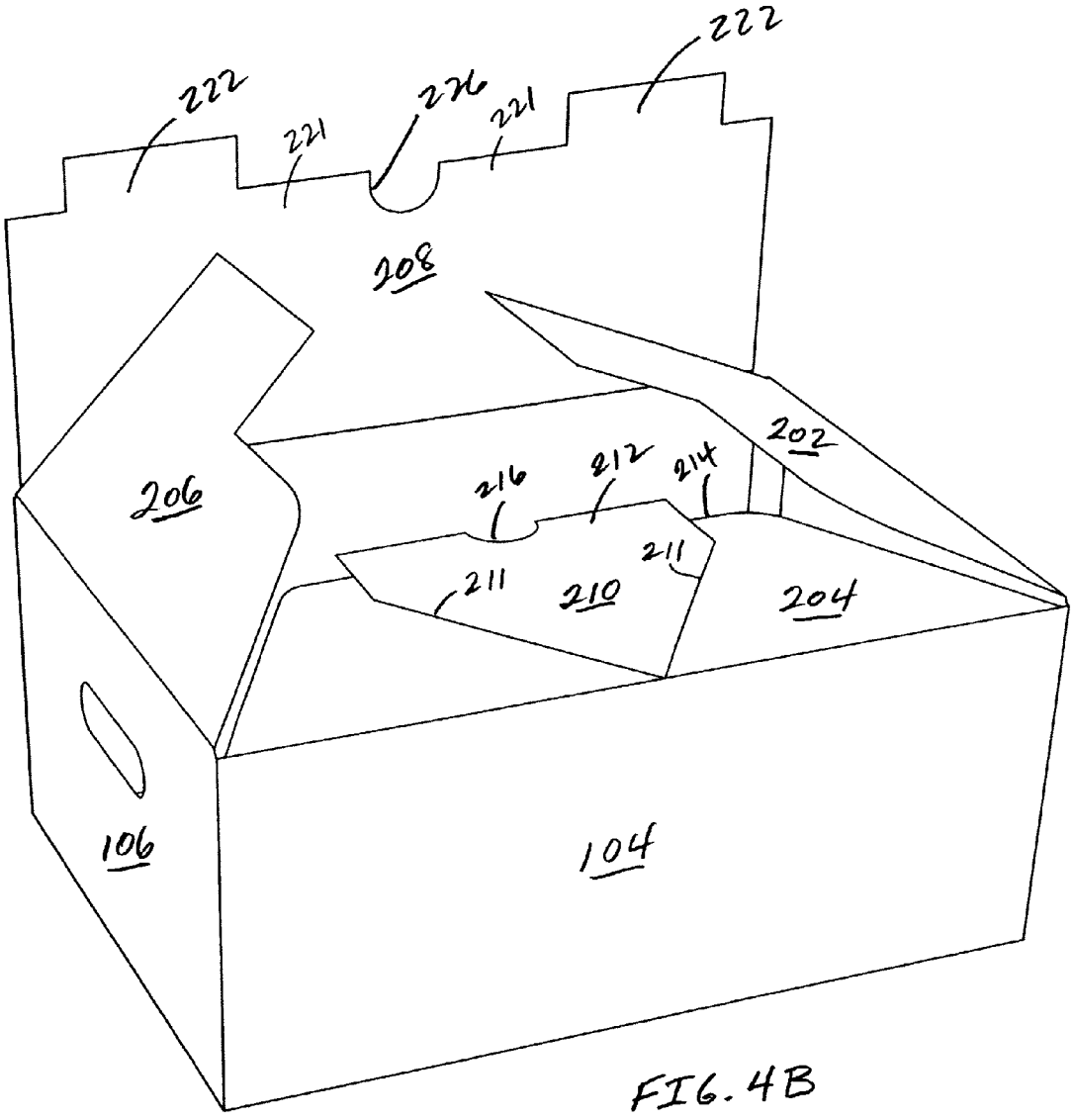
FIG. 4B illustrates a perspective view of a second step of erecting the container and a first step of closing a top of the erected container from the completed preassembly of FIG. 3.

The blank 100 of FIG. 1 is shown as an erected container, sequentially in FIGS. 4 and 4A, although the top of the container is not yet shown in its closed and locked condition. Bottom panels 302, 304, 306, 308 have been configured and glued to create a self-erecting bottom when the container is erected from the preassembly. It is within the scope of the present disclosure that other bottoms, such as non-self-erecting bottoms made from differently configured panels or structures, may be used. Blank 100 may also have a closed bottom formed by a single panel instead of the four bottom panels 302, 304, 306 and 308. Once the container is erected, as shown in FIGS. 4A and 4B, it may be filled with product and the top may be closed and locked, as will next be described.

Figure 5:
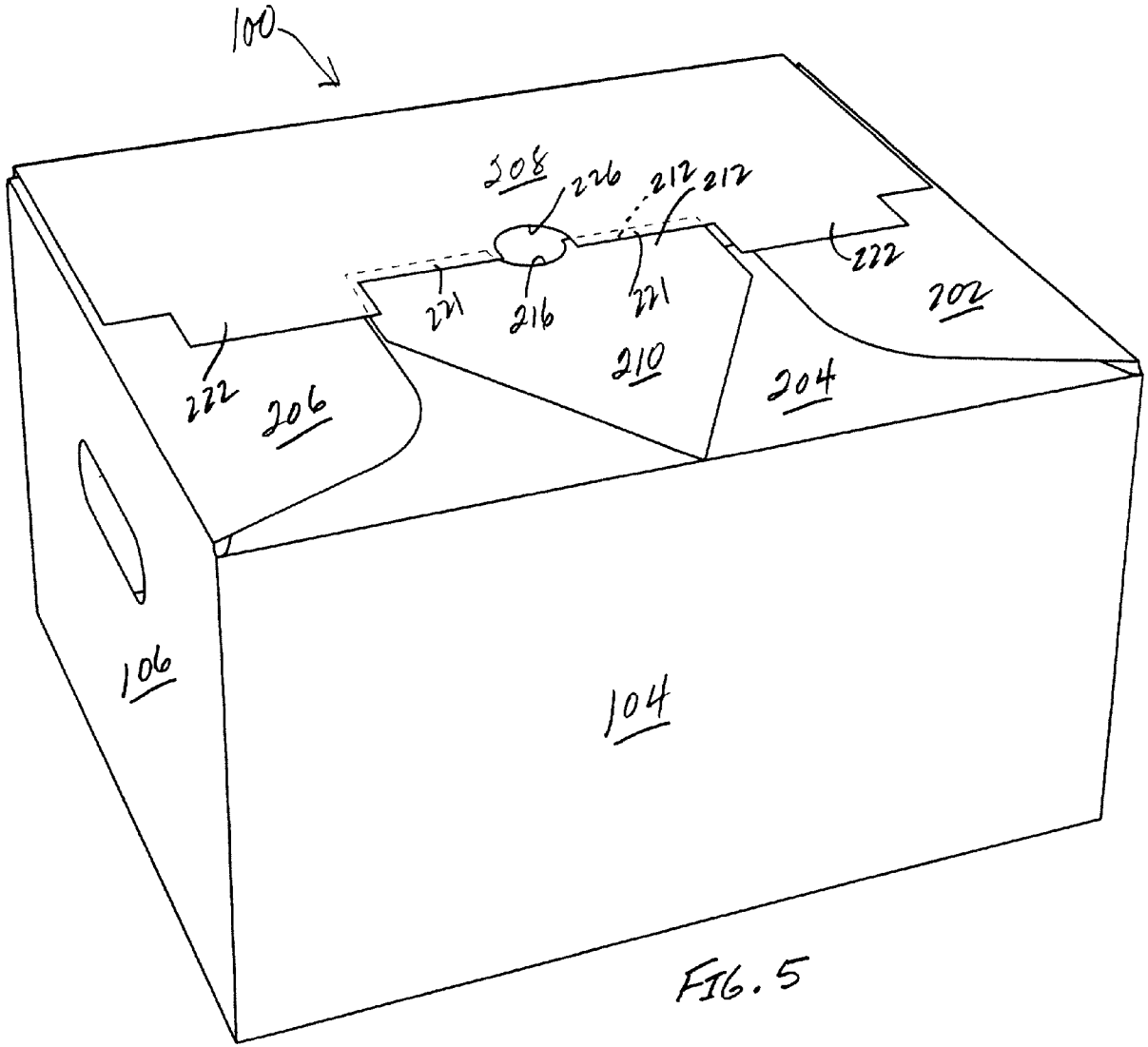
FIG. 5 illustrates a perspective view of a second step of closing the top of the erected container from the completed preassembly of FIG. 3.
Figure 9H:
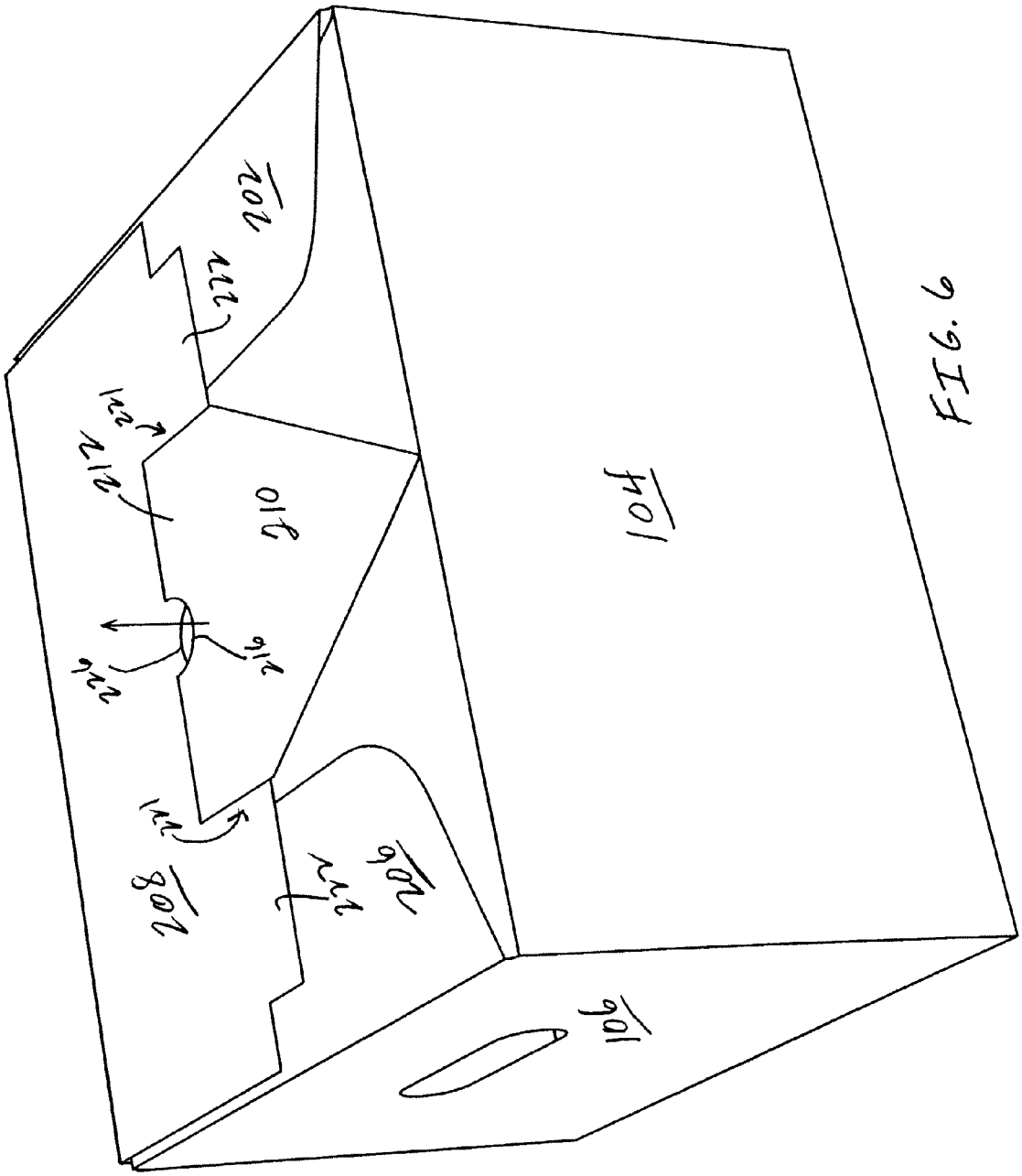
FIG. 9 illustrates a plan view of a fourth embodiment of a blank used to manufacture a preassembly and a container, the blank including a locking tab, in accordance with the present disclosure.

A method of forming a locking closure, or a closing and locking of the top of a container, is shown in FIG. 4B to FIG. 6 and includes the steps of: lowering top panel 204; lowering top panels 202 and 206 so as to at least partially overlap what is now bottommost top panel 204; lowering top panel 208 so as to at least partially overlap top panels 202 and 206 which causes top panel 208 to be the last of the top panels moved into position to essentially close an opening to the interior of the container and is designated as the topmost top panel 208. Top panel 208 is also partially overlapping extension portions 212 of locking tab 210 on bottommost panel 204. The container at this stage is shown in FIG. 5 with the top in a closed but not yet locked condition.

The method steps continue with: inserting a user's finger or other implement through the two partial openings 216 and 226; pulling the extension portion 212 of locking tab 210 upwardly and outwardly from beneath the topmost top panel 208 to a position above the locking portions 221 of topmost top panel 208. When the upward effort of the user's finger is removed, the extension portion 212 moves slightly downward onto and into engagement with locking portions 221 of topmost top panel 208 to lock the top panels, as shown in FIG. 6. Extensions 222 of top panel 208 engage portions of top panels 202 and 206 and extension portions 212 of locking tab 210 may abut or engage portions of extensions 222. Thus, the locking of the top of the container has occurred by pulling upward on locking tab 210 using openings 216 and 226. No downward movement of any of panels 202, 204, 206 or 208 is used or needed, thereby providing a locking of the top without causing damage to the contents of the container.

The embodiments of FIGS. 7-11, according to the present disclosure, are designated as blanks 200, 300, 400, 500, 600, and 700, respectively, and include variations of the structure of locking tab 210 which are designated as locking tabs 310, 410, 510, 610, and 710. Blanks 200, 300, 400, 500, and 600 include some of the same reference numerals as in FIG. 1 referring to certain features of the blanks. For example, each locking tab 310, 410, 510, 610, and 710 includes an outer edge 214, and each blank includes panels 102, 104, 106, 108, 202, 204, 206, 208, 302, 304, 306, 308 and their respective fold lines and cut lines, except where different designations are noted below or in the Figures.

Features of locking tabs 310, 410, 510, 610, and 710 include some numerical designations that are different from locking tab 210 of FIG. 1. Locking tabs 310, 410, 510, 610, and 710 function or operate essentially the same as locking tab 210, except as may be noted below. That is, most importantly, each locking tab 310, 410, 510, 610, 710 on bottommost panel 204 is pulled upwardly and outwardly to overlay topmost panel 208 to establish a locking of the top of the container.

Locking tabs 310, 410, 510, 610, and 710 each include an extension portion 312, 412, 512, 612, and 712, respectively, having a width W1. Each top panel 208 includes a pair of locking extensions 222 having a width W2 between inside edges of the spaced apart locking extensions 222. And, each width W2 is sufficiently greater than width W1 to accommodate the respective extension portion 312, 412, 512, 612, and 712.

Figure 7:
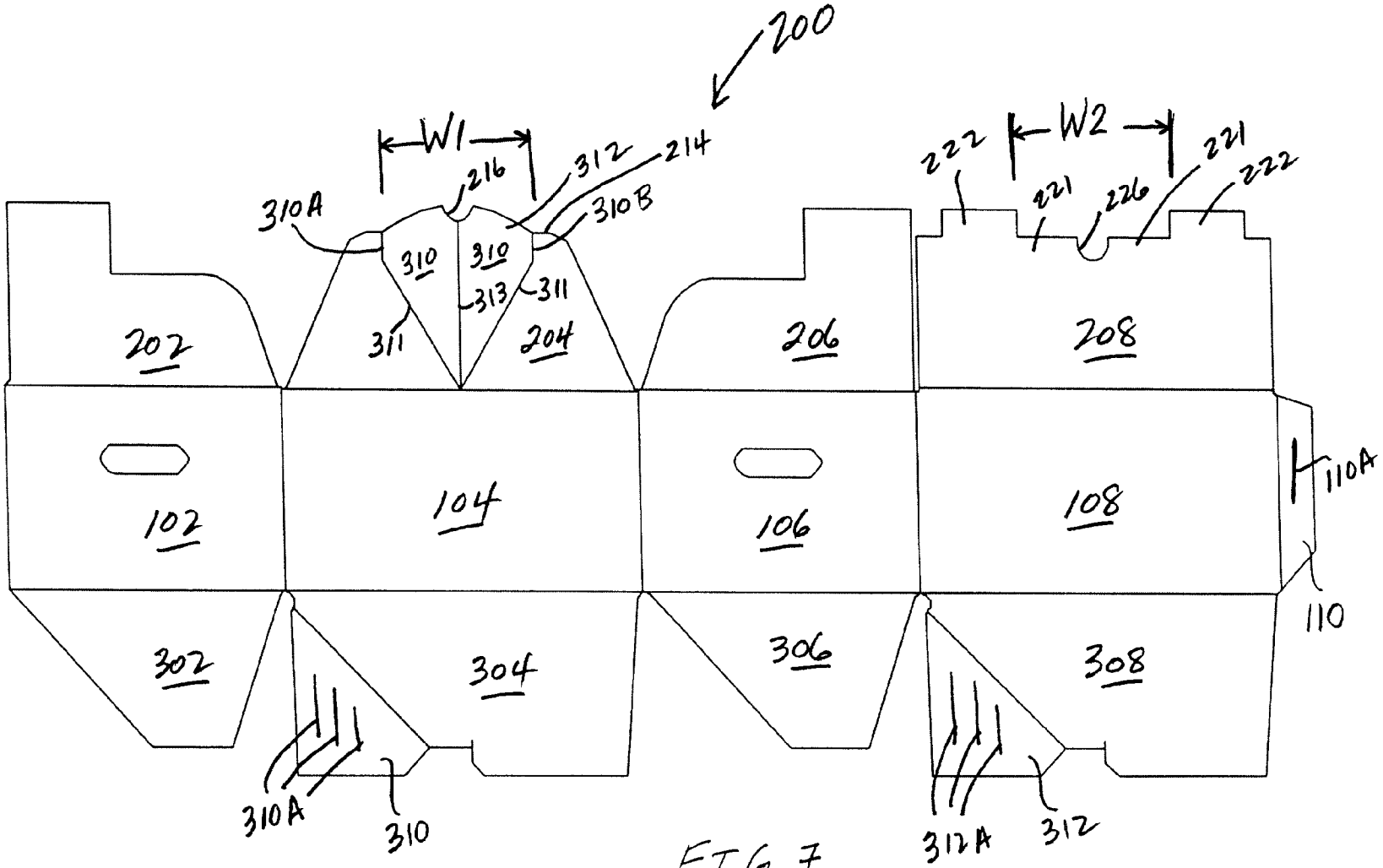
FIG. 7 illustrates a plan view of a second embodiment of a blank used to manufacture a preassembly and a container, the blank including a locking tab, in accordance with the present disclosure.

In FIG. 7, blank 200 includes a locking tab 310. Locking tab 310 is shown including fold lines 311 and maintaining substantially a "V" shape as in locking tab 210. However, locking tab 310 includes a rounded shape at its outer end and includes partial opening 216. Locking tab 310 includes cut lines 310A, 310B and a center fold line 313, all of which aid, along with fold lines 311, in the upward movement of extension portion 312 of locking tab 310 during the locking of the top of the container.

Figure 8:
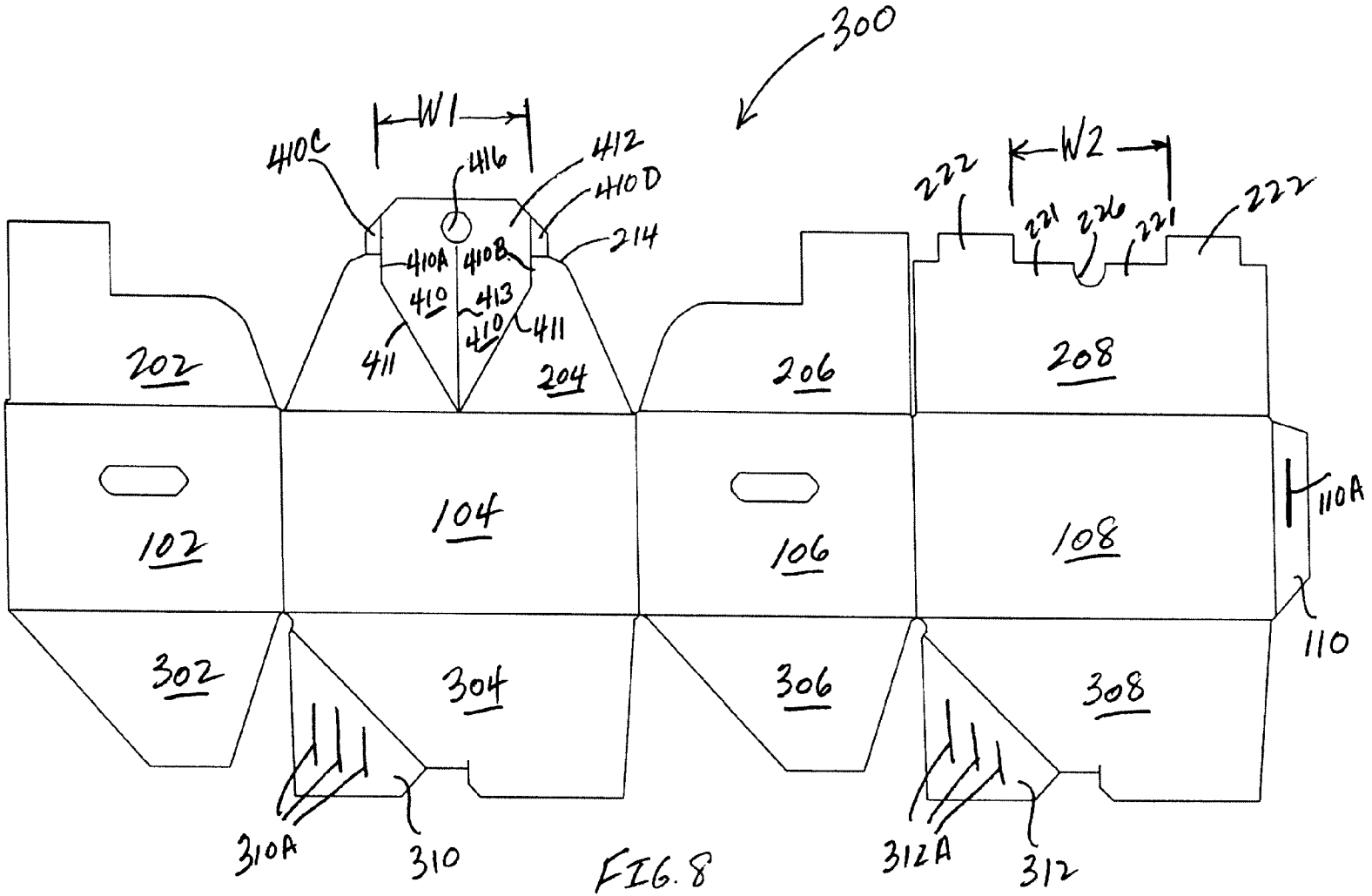
FIG. 8 illustrates a plan view of a third embodiment of a blank used to manufacture a preassembly and a container, the blank including a locking tab, in accordance with the present disclosure.

In FIG. 8, blank 300 includes a locking tab 410. Locking tab 410 is shown including fold lines 411 and maintaining a "V" shape as in locking tab 210. Locking tab 410 includes cut lines 410A, 410B and also includes a set of projections or ears 410C and 410D that add additional overlap and/or friction at the interaction of extension portions 412 with panel 208 during a locking of the top of the container. Cut lines 410A, 410B, a center fold line 413, and fold lines 411 all aid in the movement of extension portions 412 during a locking of the top of the container. Locking tab 410 also includes a full circular opening 416 to provide easier access, along with partial opening 226 of panel 208, to manipulate locking tab 410 during a locking of the top of the container.

Figure 9:
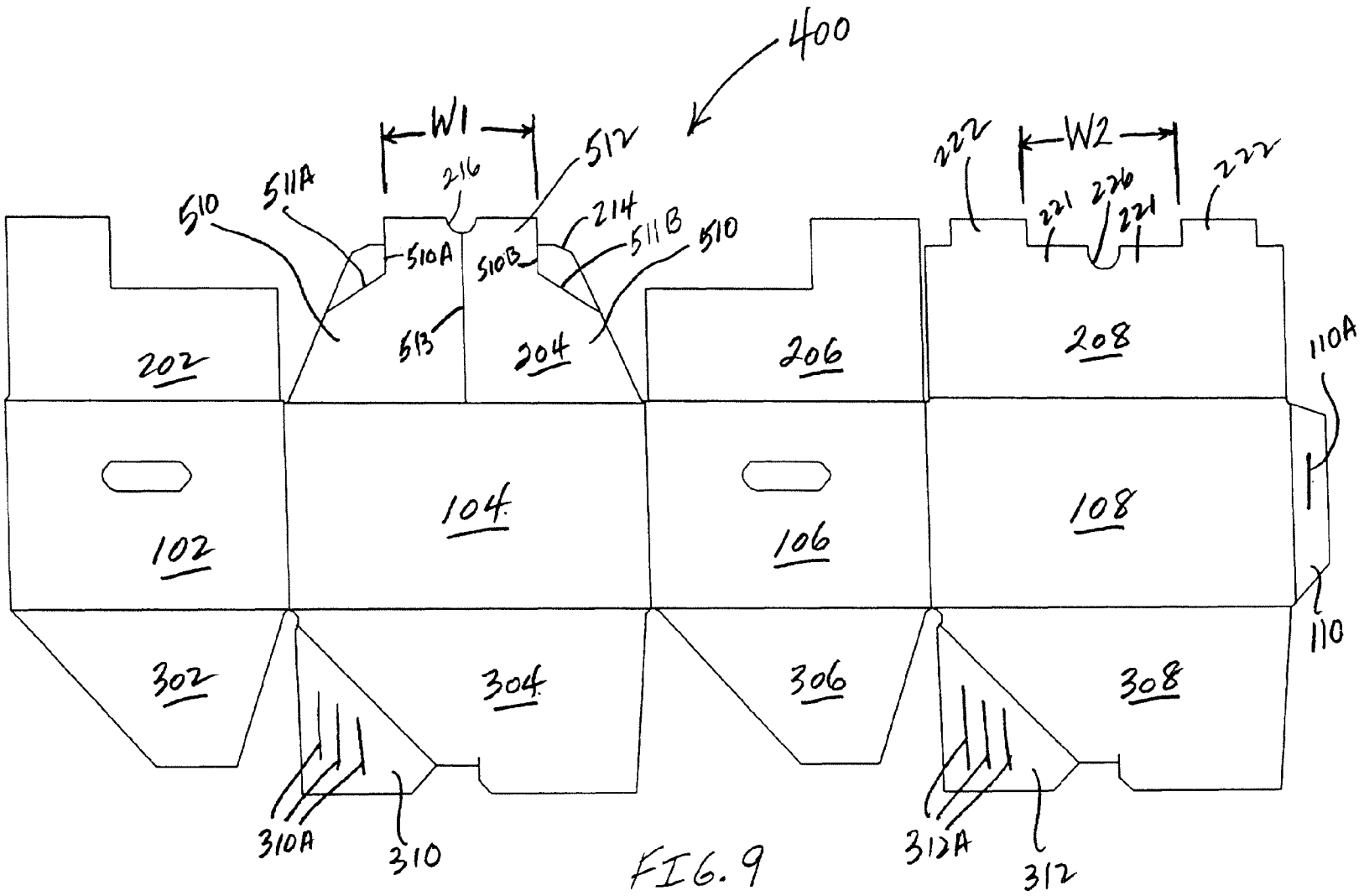

In FIG. 9, blank 400 includes a locking tab 510. Locking tab 510 is shown as no longer including a "V" shape but including cut lines 510A, 510B, angled fold lines 511A and 511B as well a center fold line 513, all of which are configured to aid in movement of locking tab 510 during locking of the top of the container. Partial opening 216 cooperates with partial opening 226 to provide access to allow the upward lifting of locking tab 510 during a locking of the top of the container.

Figure 10:
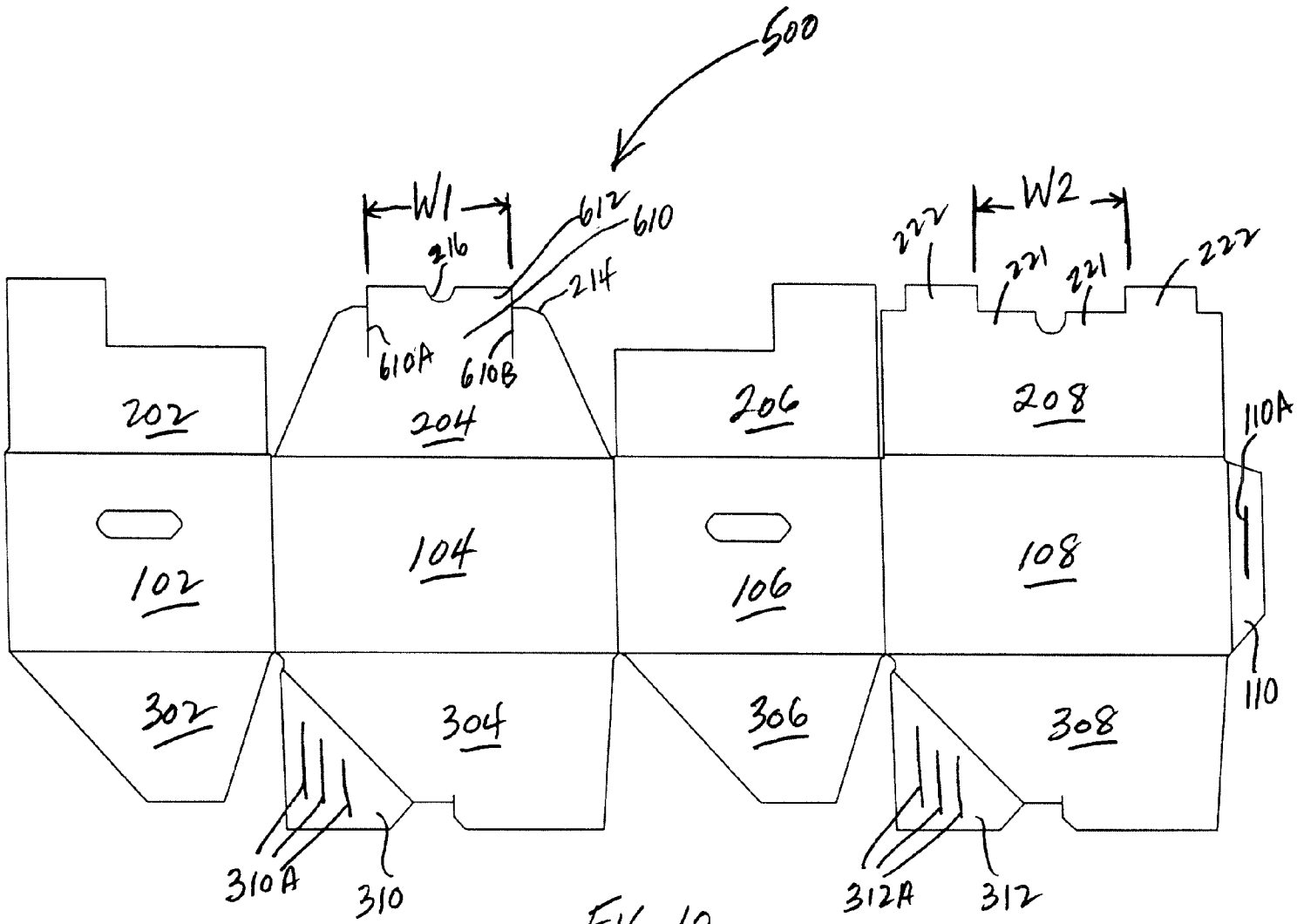
FIG. 10 illustrates a plan view of a fifth embodiment of a blank used to manufacture a preassembly and a container, the blank including a locking tab, in accordance with the present disclosure.

In FIG. 10, blank 500 includes a locking tab 610. Locking tab 610 includes cut lines 610A and 610B as well as partial opening 216. It is noted that no fold lines are included in locking tab 610. Partial opening 216 and partial opening 226 on panel 208 cooperate to provide access to be able to upwardly lift locking tab 510. Cut lines 510A, 510B aid in movement of locking tab 510 during a locking of the top of the container.

Figure 11:
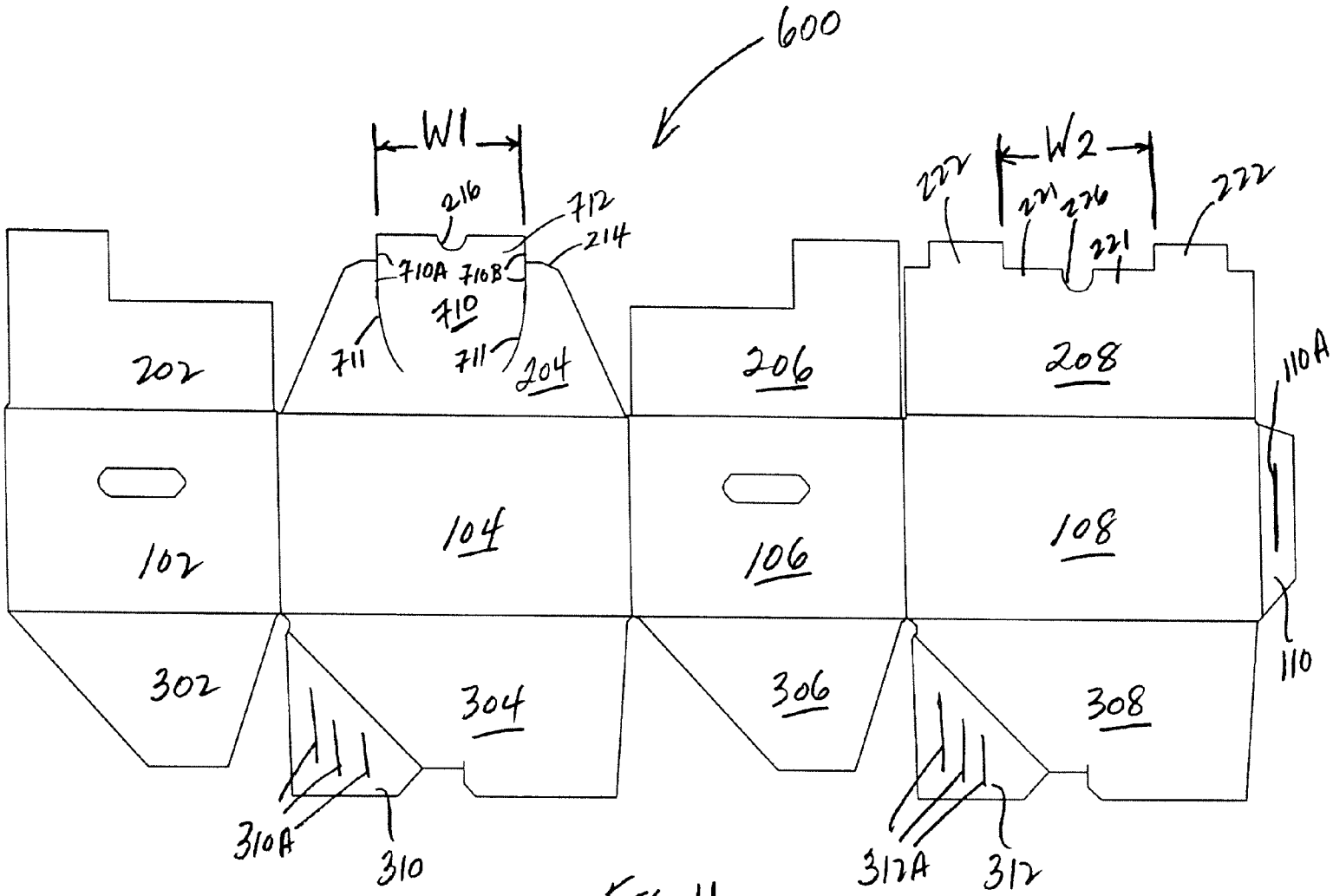
FIG. 11 illustrates a plan view of a sixth embodiment of a blank used to manufacture a preassembly and a container, the blank including a locking tab, in accordance with the present disclosure.

In FIG. 11, blank 600 includes a locking tab 710. Locking tab 710 includes extension portion 712 and partial opening 216 and also includes cut lines 710A, 710B and fold lines 711 to aid in the upward movement of locking tab 710 during locking of the top of the container.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A method of forming a locking closure of a container, the container including bottom, side, and top walls with at least one of the walls being an opening wall formed of panels which provide an opening to an interior of the container, and which panels overlap to provide a locking closure of the opening wall, the method steps comprising;

providing a first, second, third and fourth panels of the opening wall, the first panel being a bottommost panel, the second and third panels lying adjacent to opposite sides of the bottommost panel, and the fourth panel being a topmost panel;

lowering the bottommost panel to partially cover the interior of the container;

lowering the second and third panels to at least partially overlap the bottommost panel;

lowering the topmost panel to at least partially overlap the second, third and bottommost panels;

lifting a tab portion of the bottommost panel upwardly and above the topmost panel; and positioning the lifted tab portion to lie in contact with and in an overlapping position on top of a portion of the topmost panel, thereby forming the locking closure.

2. The method of claim 1, wherein the tab portion includes an extension portion and the topmost panel includes at least one locking portion configured to interact with the extension portion when the locking closure is formed.

3. The method of claim 1, wherein the tab portion includes at least a first partial opening and the topmost panel includes at least a second partial opening, and the partial openings cooperate to provide access to the tab portion by a user to permit the positioning of the tab portion to lie in the overlapping position on top of the portion of the topmost panel to form the locking closure.

* * * * *